US006539577B1

(12) United States Patent
Okuda et al.

(10) Patent No.: US 6,539,577 B1
(45) Date of Patent: Apr. 1, 2003

(54) VACUUM CLEANER SUCTION TOOL WITH PARTITION DEFINING AIR CURRENT DUST PICKUP PATH

(75) Inventors: Atsushi Okuda, Kanzaki-gun (JP); Atuo Hamada, Kasai (JP); Souji Sakata, Kasai (JP); Kazuyoshi Yoshimi, Hikami-gun (JP); Kazumasa Kamatani, Kanzaki-gun (JP); Nobuaki Takahashi, Kasai (JP); Syuzo Ueyama, Kasai (JP); Naoki Suetugu, Hojo-cho (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/537,136

(22) Filed: Mar. 29, 2000

(30) Foreign Application Priority Data

Apr. 5, 1999 (JP) ..... 11-097387

(51) Int. Cl.[7] ..... A47L 9/04
(52) U.S. Cl. ..... 15/383; 15/391
(58) Field of Search ..... 15/383, 384, 389, 15/390, 391, 392

(56) References Cited

U.S. PATENT DOCUMENTS 1,476,004 A * 12/1923 Orr ..... 15/383
4,178,653 A * 12/1979 Tschudy ..... 15/383
4,426,751 A * 1/1984 Nordeen ..... 15/384
5,513,418 A * 5/1996 Weber ..... 15/383
6,018,845 A * 2/2000 Sueki et al. ..... 15/375
6,115,880 A * 9/2000 Wulff et al. ..... 15/351

FOREIGN PATENT DOCUMENTS

| | | |
|---|---|---|
| EP | 0182754 | 5/1986 |
| GB | 877778 | 9/1961 |
| GB | 1258875 | 12/1971 |

* cited by examiner

*Primary Examiner*—Theresa T. Snider
(74) *Attorney, Agent, or Firm*—Darby & Darby

(57) ABSTRACT

An upright electric cleaning device includes a floor suction tool formed with a long suction opening on the bottom surface thereof. A rotating brush holding chamber holds a rotating brush that extends to this long suction opening. A suction opening leading to the main cleaning device unit is formed toward one end of the rear wall of the rotating brush holding chamber. A rib, formed on the upper section of the rotating brush holding chamber, extends along the length of the rotating brush, near the rotation path of the rotating brush. An air current path is formed to take dust drawn up by the rotating brush and stopped by the rib and suck it into the suction opening leading to the main cleaning device unit. The air current path is shaped so that its cross section is smaller at an end of the air current path remote from the suction opening than it is near the suction opening to increase flow speed at the remote end. In one embodiment, an opening to the outside is formed at the remote end of the air current path to enhance air flow toward the suction opening. In a further embodiment, the enhanced air flow if further improved by venting exhaust air from the main cleaning device into the opening to positively improve air flow.

10 Claims, 8 Drawing Sheets

A-A Cross section

B-B Cross section

C-C Cross section

A-A CROSS SECTION

B-B CROSS SECTION

C-C CROSS SECTION

VACUUM CLEANER SUCTION TOOL WITH PARTITION DEFINING AIR CURRENT DUST PICKUP PATH

BACKGROUND OF THE INVENTION

The present invention relates to an electric cleaning device. More specifically, the present invention relates to an electric cleaning device equipped with a floor suction tool having a rotating brush.

In standard electric cleaning devices (floor-moving cleaning devices), a floor suction tool is formed with a wide suction opening on the bottom surface thereof. A rotating brush holding chamber holds a rotating brush that extends to the suction opening. A suction opening to the main cleaning device unit is formed at the center of the rear wall of the rotating brush holding chamber. When cleaning carpets and the like, dust picked up by the rotating brush from the carpet surface is sucked in from the suction opening formed at the center to the main unit.

In "upright" cleaning devices, the suction tool is larger than the floor suction tools used in standard electric cleaning devices described above. In order to reduce uneven cleaning, the wide suction opening on the bottom surface spans as close to the entire width of the suction tool as possible. In the United States and England, where upright cleaning devices are often used, carpets are relatively plush. Thus, the rotating brush used in upright cleaning devices is formed with a large diameter so that dust and the like that is deep in carpets can be picked up efficiently. As a result, the longitudinal dimension of the suction opening is also large.

Furthermore, in floor suction tools for upright vacuum devices, the main unit of the vacuum device is positioned at the center of the suction tool. Thus, the suction opening from the rotating brush holding chamber to the main unit of the vacuum device must be positioned to either the left or the right.

As described above, the suction openings in upright vacuum devices is larger than the suction devices of the floor suction tools in standard electric vacuum devices. Thus, increasing the degree of vacuum is difficult and the suction air speed is lower, thus making suctioning of dust difficult.

Suction currents entering the suction opening are generated in the rotating brush chamber. The rotation of the rotating brush generates circulating air currents between the brush and the walls of the rotating brush holding chamber. However, as described above, the degree of vacuum and suction air speed is low in upright cleaning devices. This causes dust picked up by the rotating brush to be caught by the circulating air currents generated by the rotating brush rather than being sucked into the suction opening, resulting in the dust being returned to the surface being cleaned (the carpet surface). This leaves residue and decreases the efficiency at which dust is sucked in.

Also, since the suction opening extending from the rotating brush holding chamber to the main unit of the cleaning device is to one side, the suction force at the other side is reduced, resulting in greater residue at the other side.

In order to overcome these problems, U.S. Pat. No. 4,178,653 provides a groove cavity extending longitudinally along the inner upper wall of the rotating brush holding chamber.

However, a gap remains between the rotating brush and the inner upper wall of the rotating brush holding chamber. This allows the dust picked up away from the suction opening to still be caught in the circulating air currents generated by the rotating brush and returned to the surface being cleaned, resulting in residue. Furthermore, forming a groove cavity on the inner upper wall of the rotating brush holding chamber also means forming a projection on the outer surface. This results in a cosmetic problem unless a two-layer structure or the like is used for the upper wall of the rotating brush holding chamber.

OBJECTS AND SUMMARY OF THE INVENTION

An object of the present invention is to overcome the problems described above and to provide an electric cleaning device that allows dust caught up by a rotating brush to be efficiently sucked into a suction opening extending to a main unit without resulting in cosmetic problems.

Another object of the present invention is to allow dust to be easily sucked in even if the dust is picked up at a position away from the suction opening.

In order to achieve the objects described above, the present invention provides an electric cleaning device including a floor suction tool wherein a long suction opening is formed on a bottom surface, a rotating brush holding chamber holds a rotating brush extending to the suction opening, and a suction opening leading to a main cleaning device unit is formed on a rear wall of the rotating brush holding chamber. A rib is extended along the length of the rotating brush in the rotating brush holding chamber, the rib being proximal to a rotation path of the rotating brush. An air current path is formed to take dust drawn up by the rotating brush and stopped by the rib and suck the dust into the suction opening leading to the main cleaning device unit.

The present invention also provides an electric cleaning device including a floor suction tool wherein a long suction opening is formed on a bottom surface, a rotating brush holding chamber holds a rotating brush extending to the suction opening, and a suction opening leading to a main cleaning device unit is formed toward one end of a rear wall of the rotating brush holding chamber. A rib extends along the length of the rotating brush in the rotating brush holding chamber, the rib being proximal to a rotation path of the rotating brush. An air current path is formed to take dust drawn up by the rotating brush and stopped by the rib and suck the dust into the suction opening leading to the main cleaning device unit.

Furthermore, the present invention also provides a rib or partition disposed at an angle so that a cross-section area of the air current path formed by the rib is larger closer to the suction opening and smaller further from the suction opening.

The present invention also provides an opening formed toward an end away from the suction opening leading to the main cleaning device unit, the opening letting air from the outside into the air current path.

The present invention also provides an opening formed toward an end away from the suction opening leading to the main cleaning device unit, the opening letting exhaust air from the main cleaning device unit into the air current path.

The present invention also provides a rib divided into a plurality of sections. Portions of adjacent rib sections are disposed in an overlapping manner to form an inflow path to the air current path.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 4(*b*) is a cross-section drawing along the B—B line of FIG. 3.

FIG. 4(*c*) is a cross-section drawing along the C—C line of FIG. 3.

FIG. 9(*b*) is a cross-section drawing along the B—B line of FIG. 8.

FIG. 9(*c*) is a cross-section drawing along the C—C line of FIG. 8.

DETAILED DESCRIPTION OF THE PREFERRED EMBODIMENTS

Figure 1:
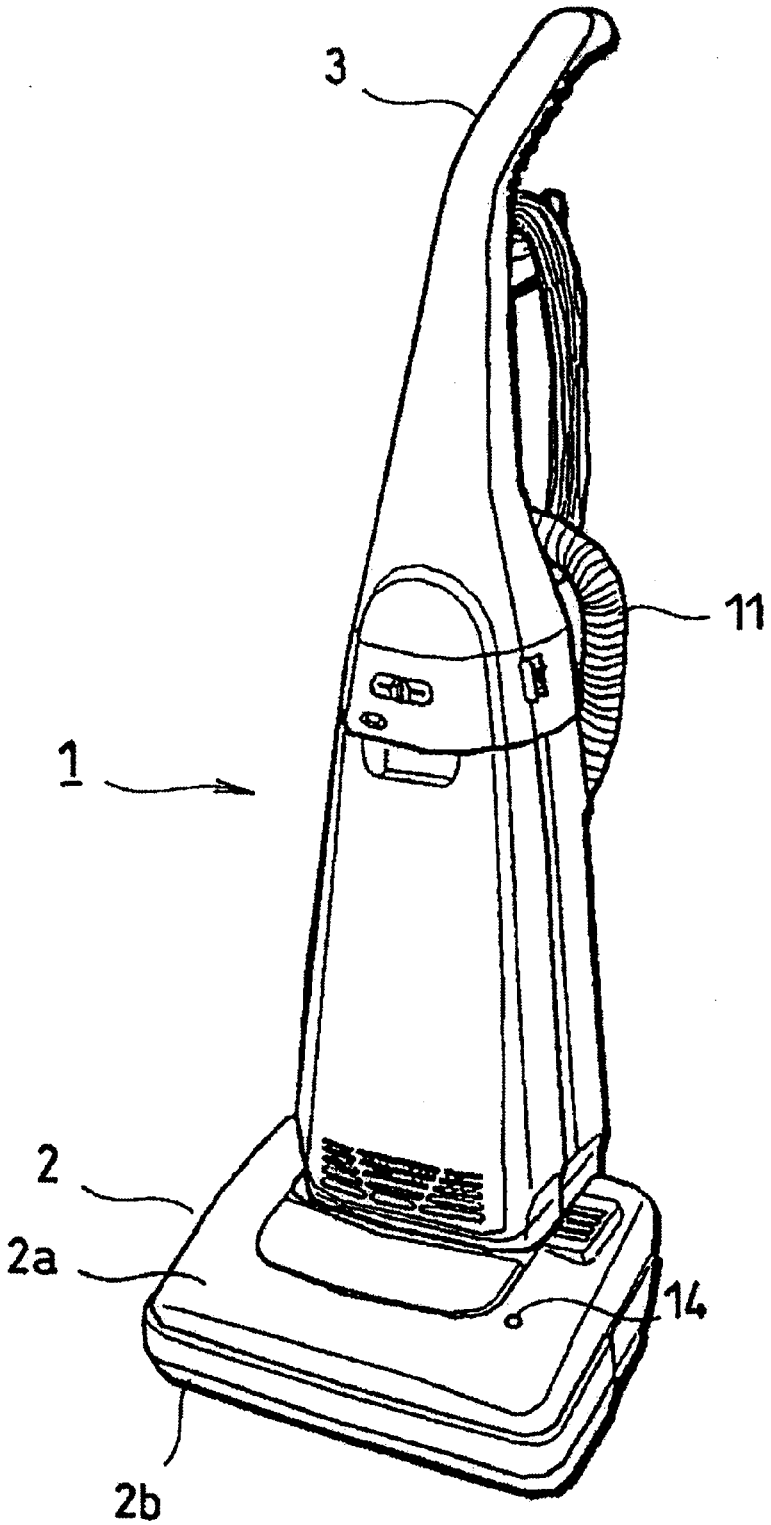
FIG. 1 is a perspective drawing, as seen from the outside, of an upright cleaning device according to an embodiment of the present invention.
Figure 2:
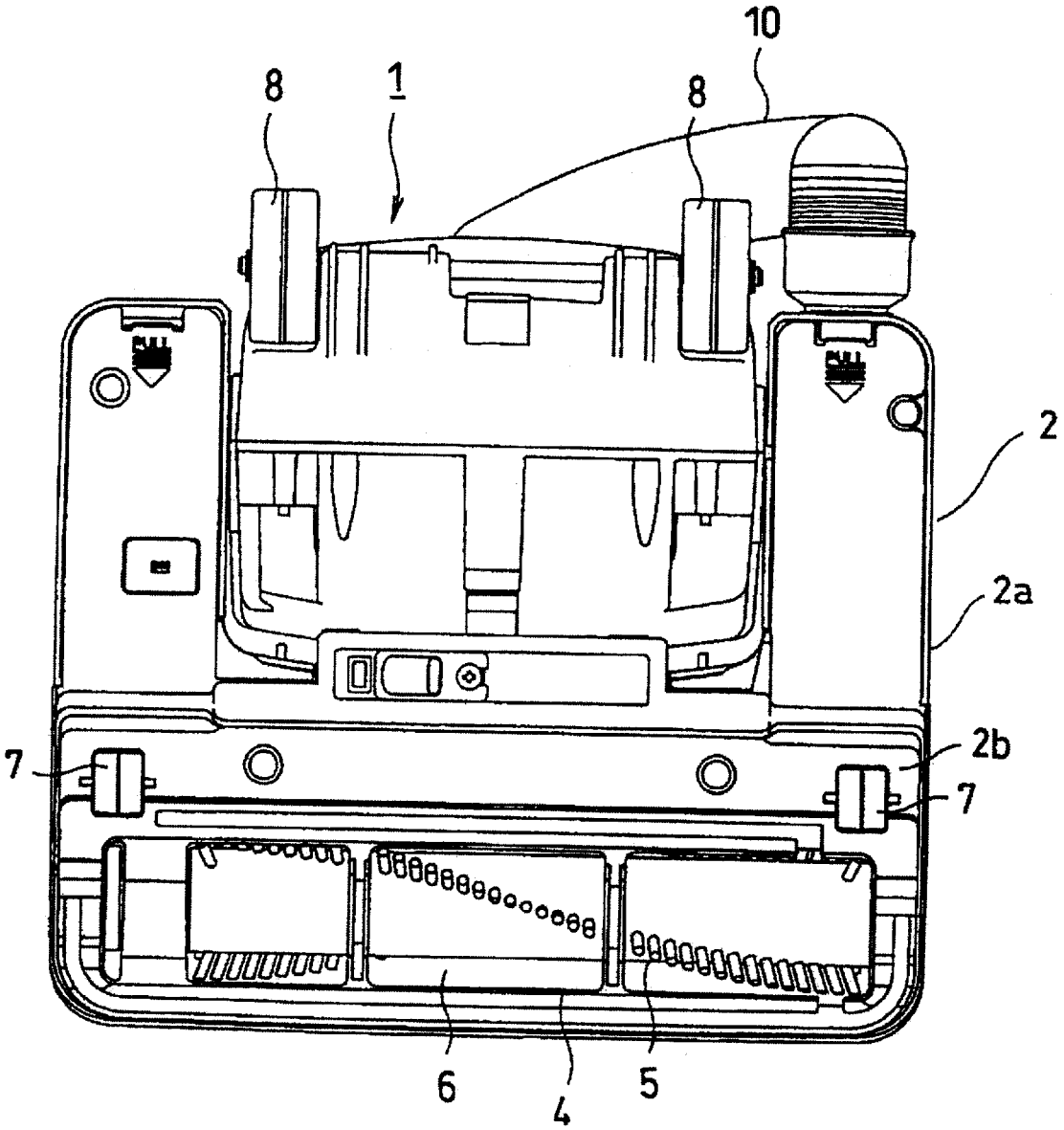
FIG. 2 is a bottom-view drawing of the same.

Referring to FIG. 1 through FIG. 4(*c*), an upright cleaning device, shown generally at 1, includes a floor suction tool 2 formed integrally with the lower section of a vertical main section of cleaning device unit 1. A handle 3 is formed integrally with the upper section of cleaning device 1. The main cleaning device unit 1 is connected to the floor suction tool 2 so that it can be tilted back for the comfort of the user. Carpets and floors can be cleaned by using the handle 3 to move the main cleaning device 1 back and forth while tilted backward.

The outer covering of the floor suction tool 2 is formed from an upper case 2*a* and a lower case 2*b*. A wide suction opening 4 is formed at the front of the bottom surface of the floor suction tool 2. A rotating brush chamber 6 holds a rotating brush 5 that extends partly through the suction opening 4.

The rotating brush 5, known as a power brush, is connected via a belt or the like to a shaft of a motorized blower (not shown in the figure) that is internally mounted at a lower portion of the main cleaning device unit 1. The rotating brush 5 is rotated in a direction that allows dust to be brought up toward a rear wall 6*a* of the rotating brush holding chamber 6 (the direction indicated by the arrow in FIGS. 4(*a*)–(*c*).

Left and right front wheels 7, 7 are attached to the front of the bottom surface of the floor suction tool 2. Left and right rear wheels 8, 8 are attached to the rear of the bottom of the main cleaning device unit 1.

A pipe 10 is connected at one end of the back surface of the floor suction tool 2. The pipe 10 communicates with a suction opening 9, which leads to the main unit 1. The pipe 10 is connected toward one end of the rear wall 6*a* of the rotating brush holding chamber 6. An end of a hose 11 is removably attached to the pipe 10. This hose 11 is connected to a suction column (toward the back surface of the main cleaning device unit 1) leading to a dust collection chamber in the main cleaning device unit 1.

Figure 3:
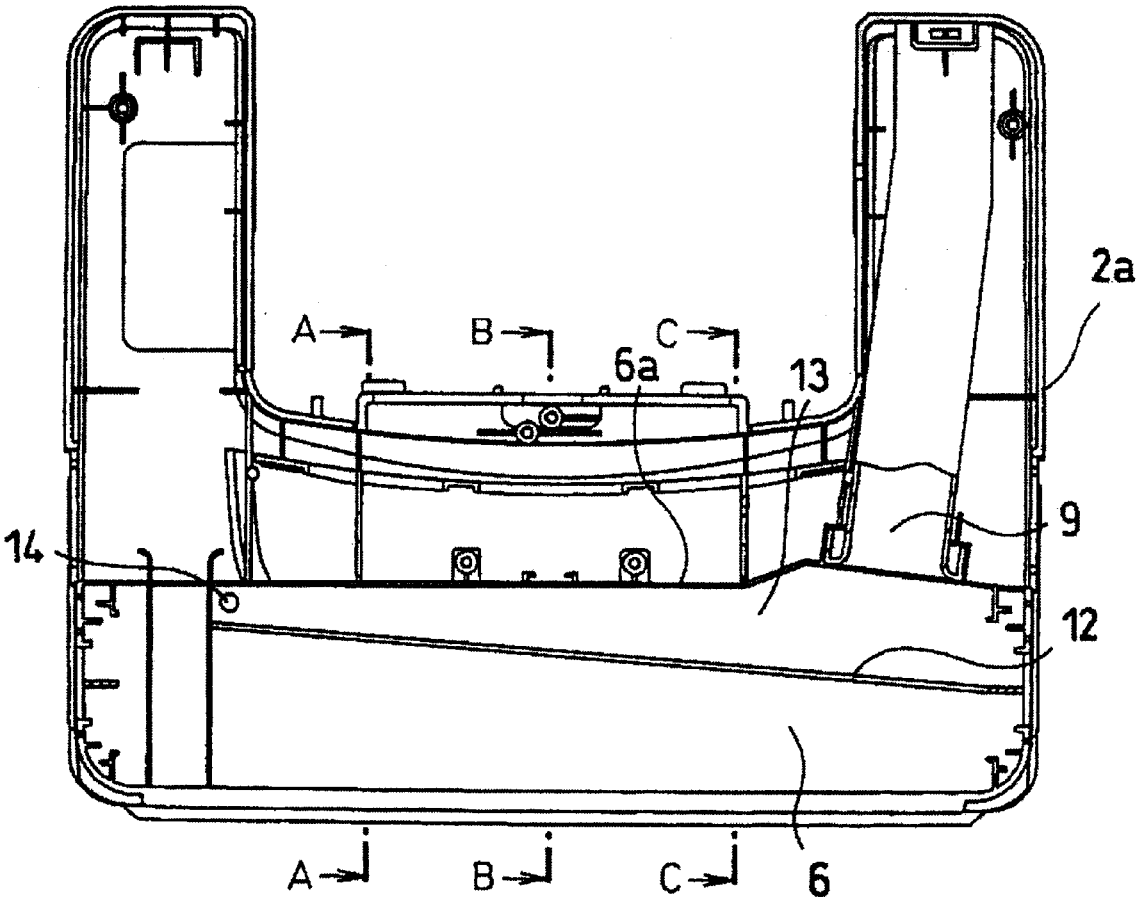
FIG. 3 is a rear-view drawing of an upper case of a floor suction tool according to this embodiment.
Figure 4A:
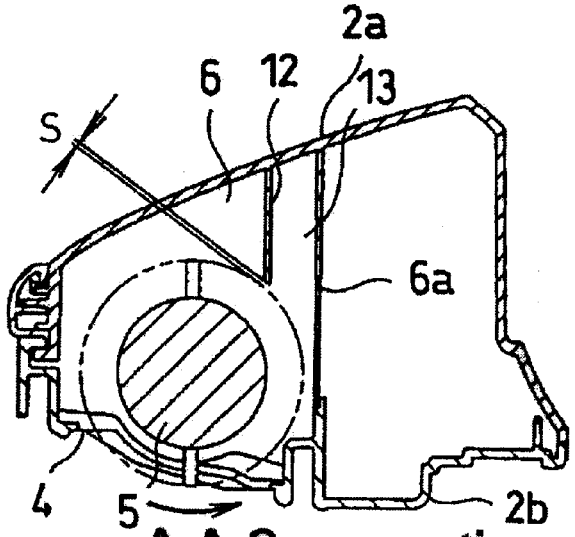
FIG. 4(*a*) is a cross-section drawing along the A—A line of FIG. 3.
Figure 4B:
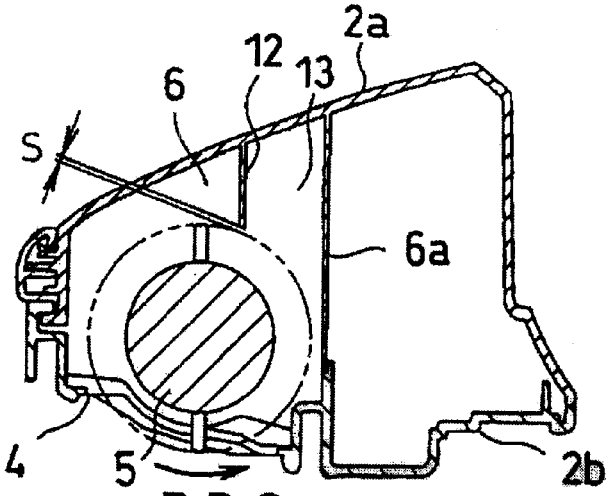
Figure 4C:
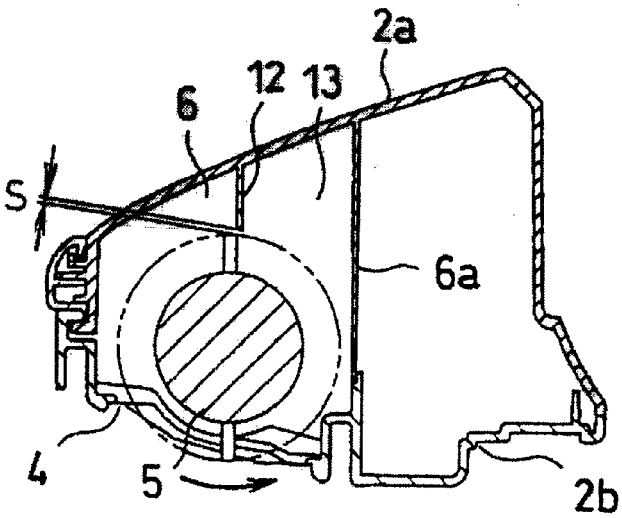

Referring to FIG. 3 and FIGS. 4(*a*)–4(*c*), the upper case 2*a* is formed with a rib 12 positioned at an upper section of the rotating brush holding chamber 6. The rib 12 extends along the long axis of the rotating brush 5 and is close to the rotation path thereof. This rib 12 forms an air current path 13 that stops dust brought up by the rotating brush 5 and sucks it into the suction opening 9 leading to the main cleaning device unit 1.

The rib 12 is formed at an angle relative to the rotating brush 5 so that the cross-section area of the air current path 13 formed by the rib 12 gets larger toward the suction opening 9 leading to the main cleaning device unit 1 and smaller going the other way. The changing cross-sectional area of the air current path 13 controls the suction air flow across the path to equalize the amount of dirt picked up, and to minimize the redeposition of debris on the floor surface.

Referring to FIG. 3 and FIGS. 4(*a*)–(*c*), the distance between the rib 12 and the rear wall 6*a* of the rotating brush holding chamber 6 becomes wider toward the suction opening 9 leading to the main cleaning device unit 1. With this structure, the positioning relative to the rotating brush 5 changes. As a result, the vertical length from the upper case 2*a* changes continuously so that the gap between the rib 12 and the rotation path of the rotating brush 5 is a small distance S regardless of the position along the length of the rotating brush 5.

An opening (small opening) 14 is formed on the upper surface of the upper case 2*a* at the end that is distant from the suction opening 9 leading to the main cleaning device unit 1. The opening 14 allows outside air to be introduced into the air current path 13 at the narrow end of the air current path 13.

When an upright cleaning device having the structure described above is used to clean a carpet or the like, an electric air blower mounted in the main cleaning device unit 1 toward the bottom is run. This applies suction via the pipe 10 from the rotating brush holding chamber 6 to the suction opening 9 toward one end of the rear wall 6a of the rotating brush holding chamber 6. Also, the rotating brush 5 is rotated at high speeds in the direction indicated by the arrow in FIGS. 4(*a*)–4(*c*).

Near the suction opening 9, the dust drawn up from the carpet surface by the rotation of the rotating brush 5 is sucked in directly to the suction opening 9. However, the suction force normally diminishes as the distance from the suction opening 9 increases. Thus, the dust particles from these positions tend to be drawn into the rotating air currents generated by the rotating brush 5 and attempt to pass along the upper section of the rotating brush holding chamber 6 and toward the front.

However, as described above, the rib 12 is formed perpendicularly downward at the upper part of the rotating brush holding chamber 6 and extends to a position close to the rotation path of the rotating brush 5. This rib 12 stops dust and concentrates the dust in the air current path 13 formed between the rear wall 6*a* of the rotating brush holding chamber 6 and the rib 12. These dust particles are moved along by the air current flowing from the opening 14 along the air current path 13 and are sucked into the suction opening 9 leading into the main unit 1. Thus, dust particles brought up by the rotating brush 5 can be effectively sucked into the suction opening 9 leading into the main unit 1.

In particular, with this type of upright cleaning device, the suction opening 9 leading into the main unit 1 is disposed toward one side since it is difficult to position it at the center. As a result, the suction force is reduced significantly toward the other end, allowing dust to be taken up by the rotating air current generated by the rotating brush 5. The dust taken up at these positions, however, is stopped at the rib 12 and guided by the air current path 13 to the suction opening 9. This provides more efficient operation.

As described above, the rib 12 is formed at an angle so that cross-section area of the air current path 13 formed by the rib 12 is larger toward the suction opening 9 leading to the main unit 1 and smaller going the other way. Thus, the reduction of suction force, which decreases away from the suction opening 9, offset by reduced cross-section area of the air current path 13. As a result, dust drawn up at positions away from the suction opening 9 leading to the main unit 1 can be easily sucked in.

Furthermore, the opening 14 for letting in outside air is formed at the end furthest from the suction opening 9 leading to the main cleaning device unit 1 solves the problem that air flow is difficult to achieve at the end away from the suction opening 9. In the invention the flow of outside air through opening 14 enhances air flow in that location. This further improves suctioning of dust.

In upright cleaning devices where the suction opening 9 leading to the main unit 1 is at one side, rather than at the center, these factors are especially effective since the reduction in suction force at the end remote from the suction opening can be significant and air flow tends to be weak.

Also, since the rib 12 is formed in the rotating brush holding chamber 6, no outward projections or the like are formed. This prevents the outward appearance of the floor suction tool 2 from being negatively affected.

Figure 5:
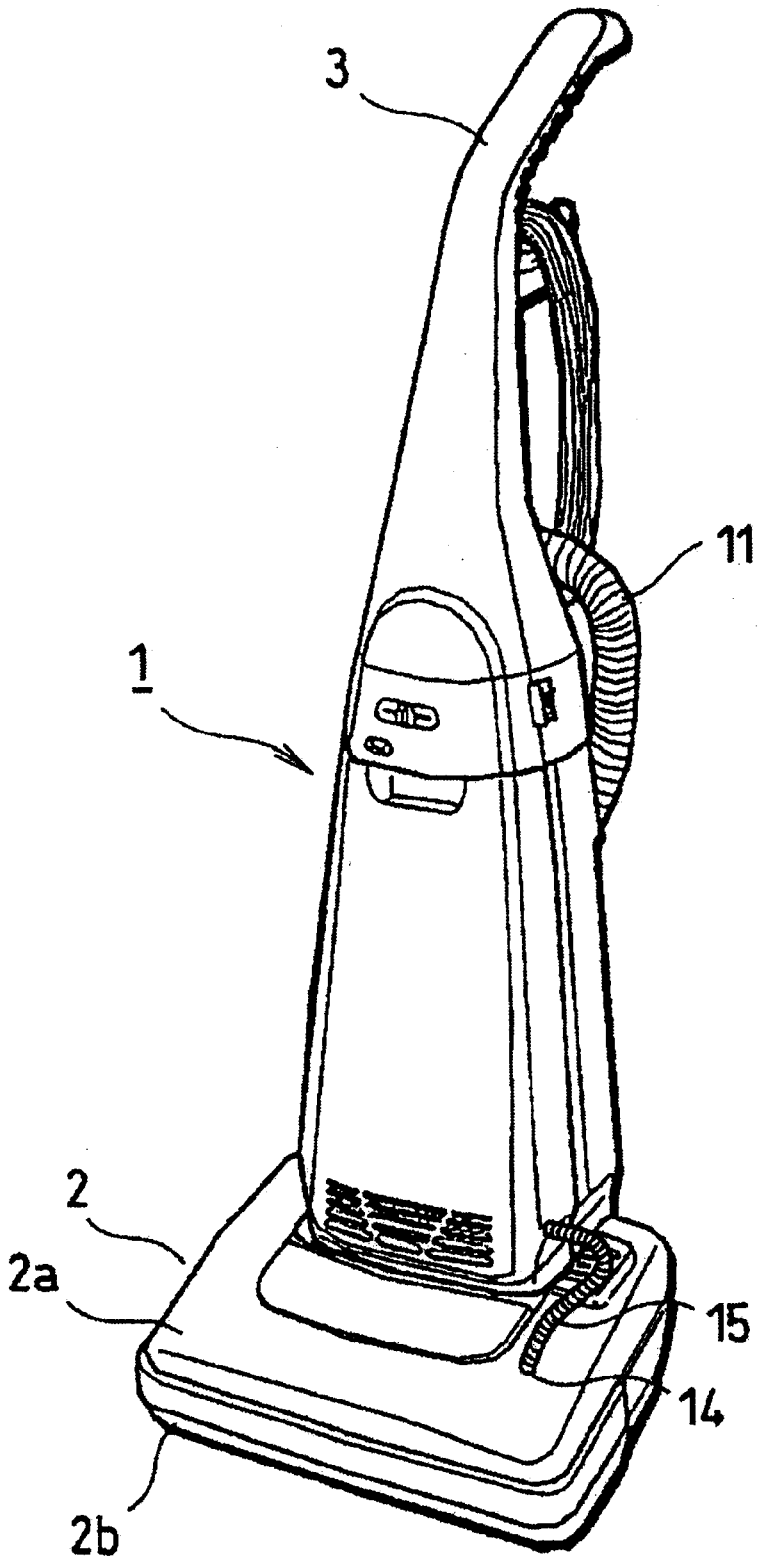
FIG. 5 is a perspective drawing, as seen from the outside, of an upright cleaning device according to another embodiment of the present invention.

FIG. 5 is a perspective drawing of the outer view of an upright cleaning device according to another embodiment of the present invention. Elements identical to or that correspond to those from the embodiment described above are assigned the same numerals.

In this embodiment, a bellows-shaped flexible hose 15 connects the opening (small opening) 14 formed at the end furthest from the suction opening 9 leading to the main cleaning device unit 1 to an exhaust chamber inside the main cleaning unit 1. This allows exhaust air in this embodiment to be fed to the air current path 13 formed in the rotating brush holding chamber 6.

In the embodiment described above, outside air is introduced directly. In this embodiment, however, exhaust air pressure is added so that adequate air flow is provided at the end remote from the main suction opening where air flow is difficult to achieve. This improves the efficiency of dust suction.

The flexible hose 15 is long enough to permit tilting the main cleaning device unit 1 all the way back relative to the floor suction tool 2.

Figure 6:
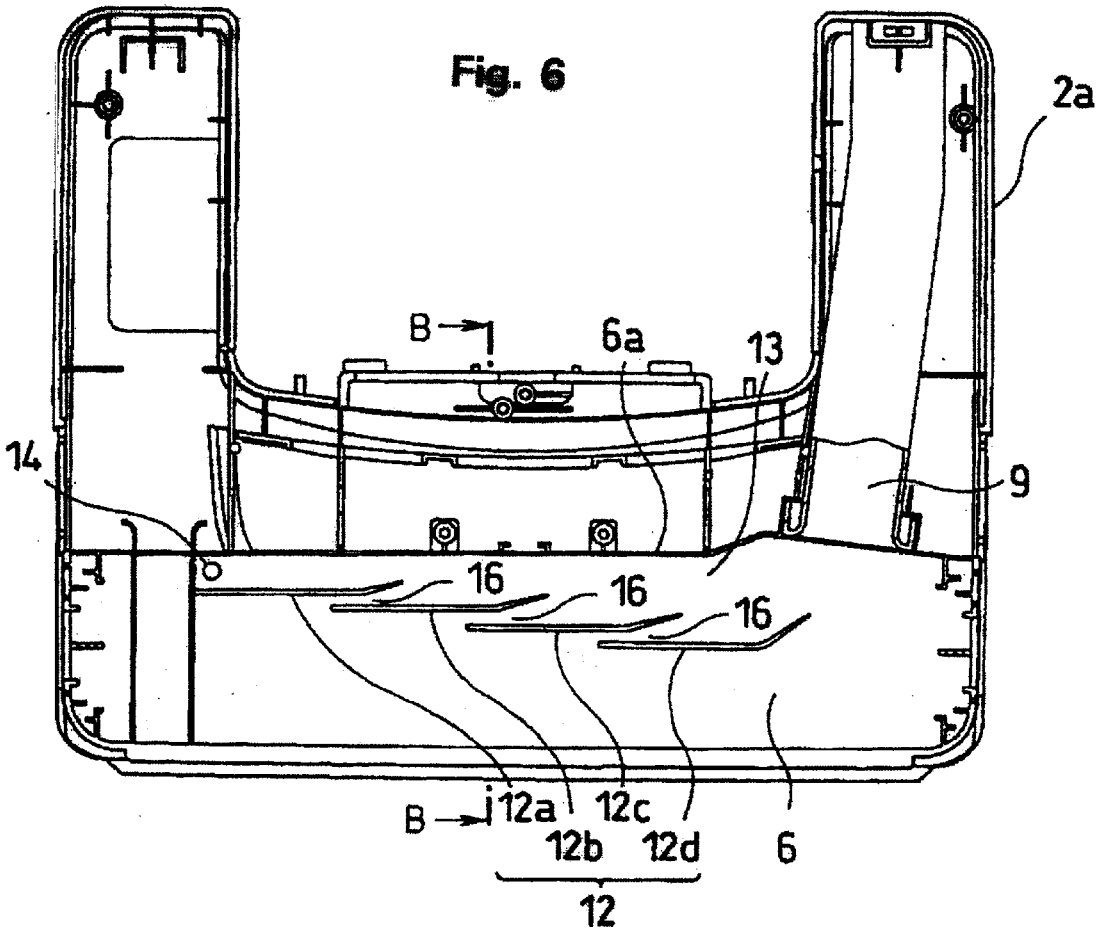
FIG. 6 is a rear-view drawing of the upper case section of a floor suction tool according to yet another embodiment of the present invention.
Figure 7:
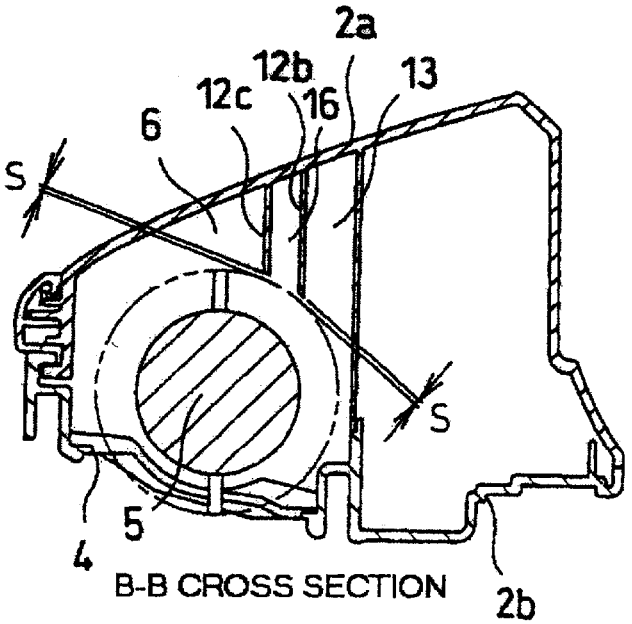
FIG. 7 is a cross-section drawing of the floor suction tool along the B—B line of FIG. 6.

FIG. 6 shows a rear-view drawing of an upper case of a floor suction tool according to yet another embodiment, and FIG. 7 shows a cross-section drawing along the B—B line. Elements that are identical to that correspond to those from the embodiments described above are assigned identical numerals.

In this embodiment, the continuously formed rib 12 from the embodiments described above is split up into a plurality of sections (in this case, four sections: ribs 12*a*–12*d*). The ribs 12*a*–12*d* are formed so that portions of adjacent ribs 12*a* and 12*b*, 12*b* and 12*c*, and 12*c* and 12*d*, overlap, separated by the width of inflow paths 16. The ends of the ribs 12*a*–12*d* that face the suction opening 9 are pointed toward the air current path 13 so that the air flowing in from the narrow inflow paths 16 spread out along the entire width of the air current path 13.

With the structure described above, air sucked in from the front of the bottom surface suction opening 4 and passing in front of the rotating brush 5 is sucked into the suction air current path 13 via the inflow paths 16. Thus, the air flow through the air current path 13 is increased, allowing dust to be sucked in more efficiently.

Figure 8:
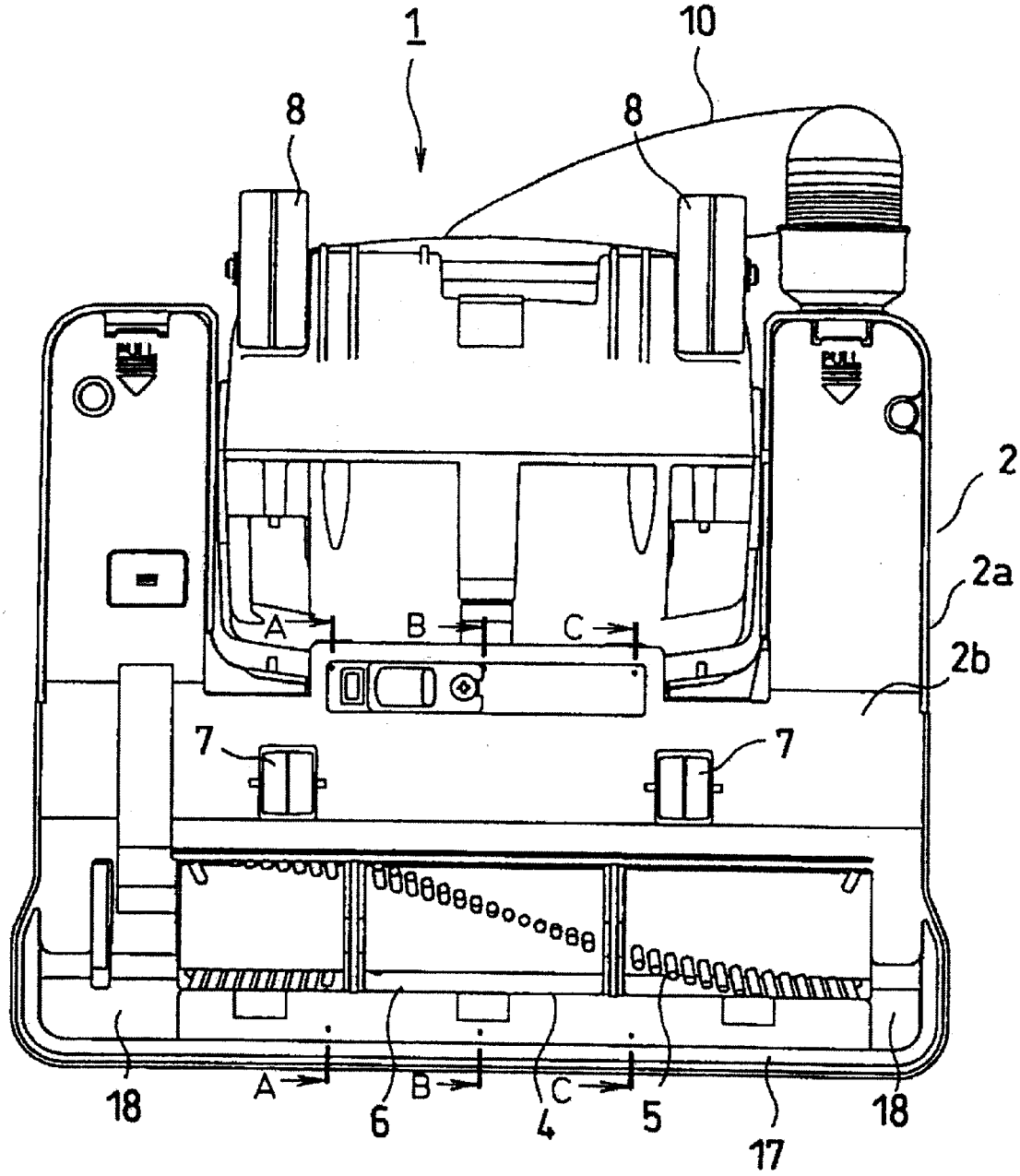
FIG. 8 is a bottom-view drawing of an upright cleaning device according to yet another embodiment of the present invention.
Figure 9A:
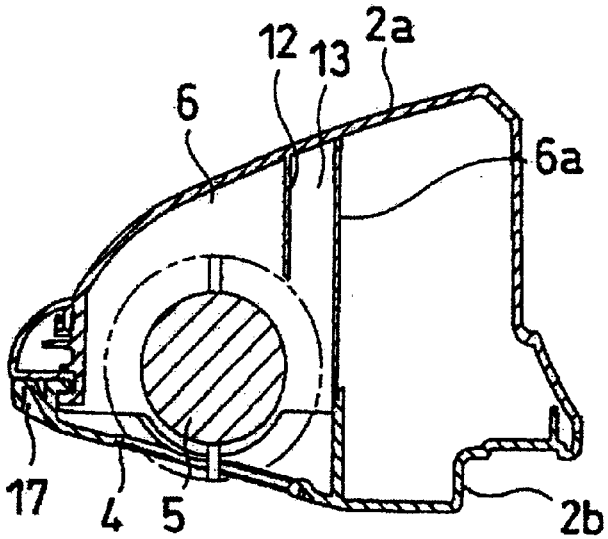
FIG. 9(*a*) is a cross- section drawing along the A—A line of FIG. 8.
Figure 9B:
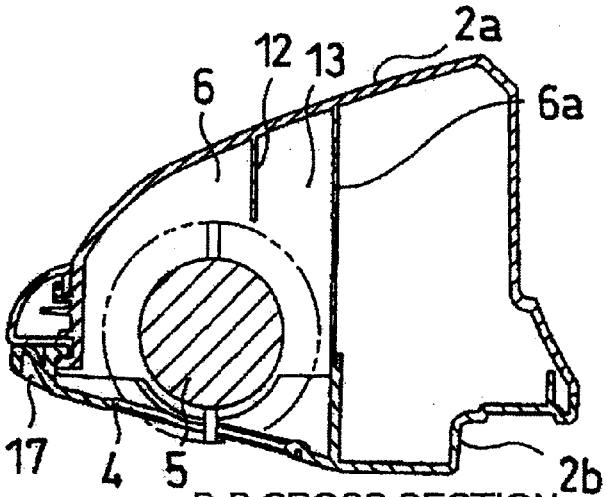
Figure 9C:
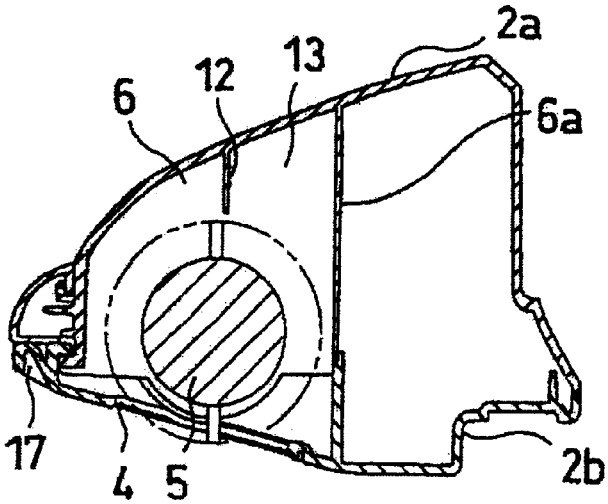

Referring to FIG. 8, there is shown a bottom-view drawing of yet another embodiment. Referring to FIGS. 9(*a*)–9(*c*), there shown cross-section drawing along the A—A, B—B, and C—C lines, respectively, of FIG. 8. In this embodiment, an improvement is added to the embodiments shown in FIG. 1 through FIG. 5. Elements that are identical to that correspond to those from the embodiments described above are assigned identical numerals.

In this embodiment, a thin groove 17 having a roughly triangular cross-section shape is formed extending along the corners and the front edge of the bottom surface of the floor suction tool 2, where the suction opening 4 is formed. Recessed communicating sections 18, 18 are formed on either side between the suction opening 4 and the thin groove 17.

In this upright cleaning device, the opening of the suction opening 4 is large. This makes it difficult to provide a high degree of vacuum or suction air speed. Thus, heavy debris such as sand is difficult to suck in. However, by forming the thin groove 17 as described above, the speed of the suction flow passing through the thin groove 17 is increased, thus allowing heavy debris such as sand to be sucked in.

Also, since the thin groove 17 is formed along the corners and the front edge of the bottom surface of the floor suction tool 2, debris against walls and corners, where the rotating brush 5 cannot reach, can be sucked in via the thin groove 17.

In this embodiment, the thin groove 17 is formed along the corners and the front edge of the bottom surface of the floor suction tool 2. It would be even more efficient to have the thin groove 17 formed behind the suction opening 4 as well. Groove 17 behind the suction opening 4 is not shown.

Also, the cross-section area of the thin groove 17 can be formed so that it is larger toward the communicating sections 18. This would allow heavy debris such as sand to be sucked in more efficiently due to the same effect provided by the air current path 13 formed from the rib 12 described above.

A communicating section 18 is formed on both sides, but it would also be possible to form one at the center.

The embodiments above describe implementations in upright cleaning devices but the same advantages can be provided when implemented in standard cleaning devices that are moved along floors.

With the present invention, a rib is disposed in a rotating brush holding chamber along the long axis of a rotating brush and close to the rotation path of the rotating brush. An air current path is formed so that dust drawn up by the rotating brush is stopped by the rib and sucked into a suction opening leading to the main cleaning device unit. Since dust drawn up by the rotating brush is stopped by the rib and concentrated in the air current path to the suction opening, dust can be sucked in more efficiently. Also, since the rib is formed in the rotating brush holding chamber, no projection or the like appears on the outside. Thus, the outer appearance of the floor suction tool is not affected negatively.

In particular, the present invention can be implemented in upright cleaning devices where it is structurally difficult to position the suction opening leading to the main unit at the center and therefore the suction opening is positioned toward one end. There is a large reduction in the suction force on the other side from the suction opening so that dust tends to be caught by the rotating air currents generated by the rotating brush. However, the dust is stopped by the rib and guided to the air current path leading to the suction opening. This provides greater efficiency.

Furthermore, the rib is formed at an angle so that the cross-section area of the air current path formed by the rib is larger toward the suction opening and smaller going the other way. Thus, the reduction of the suction force at positions away from the suction opening can be prevented by reducing the cross-section area of the air current path. As a result, dust that is drawn up at positions away from the suction opening leading to the main unit can be more easily sucked in.

An opening is formed at the end away from the suction opening leading to the main cleaning device unit to let outside air into the air current path. This allows outside air to flow in toward the end away from the suction opening, where less of an air current tends to form. As a result, an adequate air current is provided and more efficient suction is possible.

An opening to let exhaust air from the main cleaning device unit into the air current path is formed at the end away from the suction opening leading to the main cleaning device unit. This causes exhaust pressure to be added and allows an adequate air current to be formed at the end where less of an air current tends to form. Thus, suction efficiency is improved.

The rib is divided into a plurality of sections and the sections are positioned with overlapping portions so that an inflow path to the air current path is formed. As a result, the air current flowing through the air current path is increased and suction efficiency is improved.

These are also especially effective in upright cleaning devices in which the suction opening is formed toward one end rather than at the center so that there is a large reduction in the suction force on the side opposite from the suction opening and an adequate air current is difficult to maintain.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electric cleaning device including a floor suction tool, comprising:

a suction unit;

a floor suction tool comprising a brush chamber having a rotating brush housed therein;

said brush chamber having a suction opening on a bottom surface thereof wherein the brush extends therethrough and a suction inlet, formed in a rear wall, toward one end thereof leading to said suction unit;

a partition extending along a length of said rotating brush in said brush chamber;

said partition extending downward from an upper part of said brush chamber wherein said partition defines a downward plane that intersects a rotation path of said rotating brush, and where a tip end of said partition is proximal to said rotation path of said rotating brush;

said partition and a portion of said brush chamber defining an air current path therebetween; and said air current path being effective to take dust drawn up by said rotating brush and stopped by said partition and suck said dust into said suction inlet.

2. The electric cleaning device as described in claim 1 wherein said partition is disposed at an angle so that a cross-section area of said air current path formed with said partition is larger closer to said suction inlet and smaller further from said suction inlet.

3. The electric cleaning device as described in claim 1 including an opening in said brush chamber disposed toward an end away from said suction inlet, said opening letting air from the outside into said air current path, thereby to enhance air flow from said end away from said suction inlet toward an end nearer said suction inlet.

4. An electric cleaning device including a floor suction tool comprising:

a suction unit;

a floor suction tool comprising a brush chamber having a rotating brush housed therein;

said brush chamber having a suction opening on a bottom surface thereof wherein the brush extends therethrough and a suction inlet, formed in a rear wall, toward one end thereof leading to said suction unit;

a partition extending along a length of said rotating brush in said brush chamber;

said partition extending downward from an upper part of said brush chamber wherein said partition defines a downward plane that intersects a rotation path of said rotating brush, and where a tip end of said partition is proximal to said rotation path of said rotating brush;

an air current path is formed to take dust drawn up by said rotating brush and stopped by said partition and suck said dust into said suction inlet.

5. The electric cleaning device as described in claim 4 wherein said partition is disposed at an angle to an axis of said rotating brush so that a cross-section area of said air current path formed by said partition is larger closer to said suction inlet and smaller further from said suction inlet.

6. The electric cleaning device as described in claim 4 including an opening in said brush chamber disposed toward an end away from said suction inlet leading to said main cleaning device unit, said opening letting air from the outside into said air current path, thereby to enhance air flow from said end away from said suction inlet toward an end nearer said suction inlet.

7. An electric cleaning device including a floor suction tool, comprising.

a suction unit;

a floor suction tool comprising a brush chamber having a rotating brush housed therein;

said brush chamber having a suction opening on a bottom surface thereof wherein the brush extends therethrough and a suction inlet, formed in a rear wall, toward one end thereof leading to said suction unit;

a partition extending downward from an upper part of said brush chamber to a position where a tip end thereof is proximal to a rotation path of said rotating brush;

said partition and a portion of said brush chamber defining an air current path therebetween;

said air current path being effective to take dust drawn up by said rotating brush and stopped by said partition and suck said dust into said suction inlet leading to a main cleaning device unit;

an opening near an end of said brush chamber away from said suction inlet leading to said main cleaning device unit; and means for connecting exhaust air from said main cleaning device unit into said opening, whereby air flow along said air current path is aided.

8. The electric cleaning device as described in claim 7 wherein:

said partition is divided into at least first and second sections; and a first end portion of said first section overlapping a second end portion of said second section;

said overlapping portion forming an inflow path to said air current path.

9. An electric cleaning device including a floor suction tool, comprising:

a suction unit;

a floor suction tool comprising a brush chamber having a rotating brush housed therein;

said brush chamber having a suction opening on a bottom surface thereof wherein the brush extends therethrough and a suction inlet, formed in a rear wall, toward one end thereof leading to said suction unit;

a partition extending along a length of said rotating brush in said brush chamber;

said partition extending downward from an upper part of said brush chamber to a position where a tip end thereof is proximal to a rotation path of said rotating brush;

an air current path is formed to take dust drawn up by said rotating brush and stopped by said partition and suck said dust into said suction inlet leading to a main cleaning device unit;

an opening near an end of said brush chamber away from said suction inlet leading to said main leaning device unit; and means for connecting exhaust air from said main cleaning device unit into said opening, whereby air flow along said air current path is aided.

10. The electric cleaning device as described in claim 9 wherein:

said partition is divided into at least first and second sections; and a first end portion of said first section overlapping a second end portion of said second section;

said overlapping portion forming an inflow path to said air current path.

* * * * *